United States Patent [19]

Payton

[11] 4,184,912

[45] Jan. 22, 1980

[54] PITCH CONTROL METHOD

[75] Inventor: James H. Payton, Chicago, Ill.

[73] Assignee: Nalco Chemical Company, Oak Brook, Ill.

[21] Appl. No.: 961,583

[22] Filed: Nov. 17, 1978

Related U.S. Application Data

[63] Continuation of Ser. No. 861,394, Dec. 16, 1977, abandoned, which is a continuation of Ser. No. 713,302, Aug. 9, 1976, abandoned.

[51] Int. Cl.[2] ..... D21C 9/08

[52] U.S. Cl. ..... 162/72; 162/76; 162/77; 162/DIG. 4; 252/351

[58] Field of Search ..... 162/72, 74, 75, 76, 162/77, 158, 179, 168 R, 168 N, 168 NA, DIG. 4; 208/39, 44; 252/351, 353, 354, 355, 356, 357, 384

[56] References Cited

U.S. PATENT DOCUMENTS

| | | | |
|---|---|---|---|
| Re. 38,474 | 7/1974 | Anderson et al. | 260/29.6 H |
| 2,716,058 | 8/1955 | Rapson et al. | 162/72 |
| 3,081,219 | 3/1963 | Drennen et al. | 162/72 |
| 3,288,846 | 11/1966 | Irani et al. | 260/500 |
| 3,298,956 | 1/1967 | Irani et al. | 252/117 |
| 3,336,221 | 8/1967 | Ralston | 210/58 |
| 3,748,220 | 7/1973 | Gard | 162/72 |
| 3,873,417 | 3/1975 | Otrhalek et al. | 162/DIG. 4 X |
| 3,896,046 | 7/1975 | Carstens et al. | 162/DIG. 4 X |
| 4,010,067 | 3/1977 | Hoeger et al. | 162/76 |
| 4,056,430 | 11/1977 | Hoeger et al. | 162/76 |

FOREIGN PATENT DOCUMENTS

| | | | |
|---|---|---|---|
| 2408523 | 9/1975 | Fed. Rep. of Germany | 162/DIG. 4 |
| 1,375,161 | 11/1974 | United Kingdom | 162/DIG. 4 |

OTHER PUBLICATIONS

Yamada et al., *A.B.I.P.C., vol. 33, No. 12, 10983 and 10984.*

Swanson et al., "Surface Chemical Studies on Pitch", TAPPI, vol. 39, No. 10, 10-1956, pp. 684-690.

*Primary Examiner*—Arthur L. Corbin

*Attorney, Agent, or Firm*—John G. Premo; Robert A. Miller

[57] ABSTRACT

Pitch formation in paper mill pulp systems may be inhibited by treating such systems, at a point prior to where pitch deposits normally occur, with at least 0.5 ppm, based on the weight of the pulp, of a composition comprising:

| Ingredients | % by weight |
|---|---|
| Non-ionic surfactant | 50-20 |
| Anionic dispersant | 45-15 |
| Anionic Polymer having molecular weight less than 100,000 | 45-15 |

3 Claims, No Drawings

PITCH CONTROL METHOD

This application is a continuation of copending application Ser. No. 861,394, now abandoned filed Dec. 16, 1977, which in turn is a continuation of copending application Ser. No. 713,302 filed Aug. 9, 1976, now abandoned.

INTRODUCTION

Mechanics of Pitch Formation

Pitch, as it is first introduced into the papermarking system, is found adsorbed on the fiber (2%) and contained within the part of the fiber termed ray cells (98%). Even when it is within the ray cells, it is in a small particle state, attempting to achieve the greatest surface area v.s. volume possible. When viewed under a microscope, the pitch in the ray cell appears similar to eggs in a fish's egg sac.

The pitch is forced from the fiber surface and from the ray cells during the harsh process of digesting and during periods of high shear (pumps, refiners, etc.).

When the oil-loving pitch particles are released from the fiber, they enter the water system in the form of an unstable, crude dispersion. In form and activity, they are very similar to micelles or a colloidal systems, forming an unstable dispersion in suspension in the stock and water system used to process paper and pulp. This unstable dispersion completely destabilizes or breaks and the particles agglomerate when subjected to:

1. Shear
2. Temperature shock
3. pH shock

Insoluble mineral salts such as calcium carbonate aggravate the problem by providing sites for the pitch particles to adsorb and the pitch eventually acts as a binder, cementing the crystals together into a deposit. Technically, they offer liquid-solid interfaces which intensify the dispersion destabilization forces, adding greatly to the bulk of the deposit.

Filler materials, fines and fibers can become trapped within the organic matrix formed by the pitch coalesence and compound the problem. Oil carriers from wash aids and defoamers are oleophilic and tend to be attached to the oleophilic, crudely dispersed, pitch particles causing further destabilization of the dispersion and adding to the gross deposits.

Factors That Influence Pitch Formation

The composition of pitch and the amount of depositable materials are influenced by:

1. Type of wood
2. Seasoning of wood
3. Type of pulping process
4. Process water
5. Pulp washing
6. Pulp bleaching
7. System additives
8. System design

(1) Type of Wood and Its Components

| Softwood | vs | Hardwood |
|---|---|---|
| contain more fatty acids<br>contain more rosin acids | | contains more neutral organics (unsaponifiables and steriods) |

(2) Effect of Seasoning and Storage

The total amount of pitch forming organics that will be released during the pulping operation is strongly affected by its seasoning and storage. Wood stored as chips, above freezing, will "season" more quickly and completely than logs due to the greater surface area available for oxidation. The oxidation of the resinous materials tends to make the resins more soluble and easier to remove by washing.

A chemical reaction, such as oxidation, takes place more slowly during cold weather than during warm weather. It thus follows that wood seasoned in the winter will have a higher pitch forming tendency, this being the reason for the traditional late winter and spring pitch outbreaks.

(3) Pulping Process

The presence and the relative amount of fatty/rosin acids and neutral organics depend upon the type of wood and the method of pulping. These materials are responsible for most of the pitch deposition.

Kraft Cooks

Saponify natural fats completely into fatty acids and glycerine.

Sulfide Cooks

Not as severe as Kraft and may leave unsaponified fats.

Groundwood

Contain great amounts of unsaponified fats as wood is cooked.

Neutral organics are found mostly in sulfite and groundwood systems because the acidic pulping systems conditions causes any fatty acid, which do form, to be in the free acid state.

Free fatty acids are almost insoluble in water, however the sodium salts of fatty acids (present at higher pH) are true surfactants and act to form the unstable dispersion of neutral organics into a more stable natural dispersion suspended in the pulp/waste system. If the pH is lowered, they revert and the fatty acids deposit as pitch.

Kraft Cooks of hardwood pulps are more troublesome than softwood due to the higher percentage of neutral organics. Usually hardwood krafts have insufficient fatty acid salts to stabilize the neutral organic dispersion.

(4) Process Water/Washing System

The process water is very important in controlling pitch because it can aid in aggravating pitch problems or be used to help prevent pitch outbreaks by providing a dynamic system in which to suspend pitch in the form of a stable emulsion.

Water hardness, indigenous to the incoming mill water or created by system chemistry, is very important to pitch formation, especially in kraft pitch. Kraft pulp, when it leaves the digester is quite alkaline and has a very high sodium (salt cake) content.

When it enters a countercurrent brown stock washer line, the pulp is washed with cooler and cleaner water, with progressively lower solids content. At the high pH's, in the first stages of washing, all of the fatty acids are present as sodium salts, which are soluble and emulsify and non-polar organics, any calcium present in the liquor or the wood during the cook being found as precipitated calcium carbonate. If the process water used in washing is soft (natuarlly soft, chemically softened or boiler condensate), no pitch outbreaks could be expected in the water system.

However, the wash water added at most deckers or the last stages of washing usually contains a fair amount of calcium hardness. The calcium is detrimental to washing and encourages pitch formation by two different mechanisms:

A. The calcium exchanges with the sodium in the sodium soaps of the fatty acids and forms insoluble calcium soap.

$$\text{No fatty acid} + Ca^{++} \rightleftarrows \text{Ca Fatty Acid} \downarrow + Na^{+}$$

The insoluble soap (like a hard water soap scum) no longer has the ability to act as a natural surfactant (it once helped keep the pitch emulsified). The natural pitch dispersion then becomes destabilized and forms a crude dispersion, susceptible to depositing when faced with any form of shear.

B. The calcium and bicarbonate alkalinity of the wash water add to the carbonate and hydroxide alkalinity generating during the caustic cook, forcing the precipitation of calcium carbonate.

$$\text{Process Water } Ca^{++} + HCO_3^{-}$$

$$\text{Pulp} + \text{Liquor } CO_3^{--} + OH^{-}$$

$$HCO_3^{-} + OH^{-} \rightarrow CO_3^{--} + H_2O$$

$$Ca^{++} + CO_3^{--} \rightleftarrows CaCO_3$$

The calcium carbonate crystals are then available as additional liquid-solid interfaces which destabilizes the natural dispersion of pitch forming organics. The destabilized dispersion . . . or crude dispersion . . . then plates out at the decker or screen room with typical kraft pitch.

Pitch usually doesn't occur before the decker or the last stage of washing because, in countercurrent washing, the earliest stages have the highest amount of natural surfactants (sodium fatty acid salts) in the wash water and this enables a natural stable dispersion of the pitch forming materials.

In conjunction with this phenomenon, the earliest washing stages provides a higher concentration of sodium (soda) and higher pH in the wash water, allowing the sodium to displace the calcium in the fatty acid sales formed in the last stages of the washer, the fatty acid salts act much like the zeolites used in water softening in their response to concentrations of sodium and calcium ions.

$$\text{Na fatty acid} + Ca^{++} \rightleftarrows Na^{++} + \text{Ca Fatty acid}$$

The freed calcium then ties up with the available carbonate but causes no problems due to the higher levels of natural surfactants. The $CaCo_3$ and sodium soaps and then pass progressively and innocuously through to the earliest stage of washing and then to liquor recovery.

(5) Pulp Bleaching System

Pulp bleaching is important to pitch control because it provides an additional opportunity to remove resinous material from the pulp which has not been removed in washing. The naturally occuring resins are mostly unsaturated, making them somewhat prone to attack by oxidizing agents:

A. Chlorine
B. Chlorine Dioxide
C. Peroxides
D. Oxygen

The oxidation of the resins yield compounds which are more soluble in water than the original resins and are more easily removed during caustic extraction.

Calcium Hypochlorite bleaching causes problems because of calcium fatty acid formation and the possiblity of $CaCO_3$ formation.

(6) System Additives

Systems additives are very important to pitch control programs.

Fatty Acid Defoamers—If applied incorrectly or in heavy dosages add pitch forming material to the system.

Paraffin Oil Carriers—Found in most defoamers are usually non-polar and very hydrophobic and acts to destabilizer natural pitch emulsions.

Light Hydrocarbons—Petrochemicals containing kerosene or xylene are not quite as hydrophobic as the paraffin oils and tend to act as solvating agents to couple with the natural surfactants and increase the stability of the resin emulsion.

Talc—Controls pitch by providing a hydrophobic surface for the pitch particle to adsorb and thus either de-stabilizing the natural emulsion or accumulating crudely dispersed pitch particles on its surface. It attempts to bring the pitch particles together—while the Nalco system's goal is to keep them apart.

Talc provides a liquid-solid interface (similar to calcium crystals) on which the natural pitch dispersion can deposit without causing deposits on the machinery, providing the proper amount is applied. The pitch coated talc is large enough so that it tends to stay with the pulp.

System design plays an extremely important roll in pitch control. A washer designed to wash 300 TPD of pulp obviously will not be as efficient when 500 TPD are put across it. Minimizing the air-water interfaces in the washers, by proper machine designs and application of good defoamers, will help to stabilize the natural resinous emulsions.

Plastic materials in the machinery are more hydrophobic than metal parts and provide a greater de-stabilizing effect on the natural pitch emulsions than do metal parts.

OBJECTS OF THE INVENTION

The invention has as its major object the provision of a chemical additive capable of acting on a variety of paper mill stocks to prevent pitch formation.

Another object of the invention is the furnishing of a pitch control composition which is capable of dispersing and emulsifying pitch particles to an exceptionally fine state of subdivision and allowing such finely dispersed particles to be uniformly distributed throughout the finished paper in particles in microscopic size.

Another important object of the invention is to provide a pitch dispersant chemical composition which is capable of operating to prevent pitch buildup in paper mill systems at low economical dosages.

Other objects will appear hereinafter.

THE INVENTION

In accordance with the invention, it has been found that pitch formation in paper mill pulp systems may be inhibited by adding to such systems at a point prior to where pitch deposits normally occur at least 0.5 parts per million based on the weight of the pulp[1] of a 3-component formulation. This 3-component formulation is capable of acting upon the pitch contained within the pulp system to maintain it as a finely divided dispersion or emulsion of pitch particles which frequently have a particle size less than 10 microns, with the majority of the particles being in the sub-micron range.

[1]Pulp is total fiber/weight suspension.

The 3-component composition used in the practice of the invention has the further advantage of being effective in dispersing or emulsifying pitch which commonly occurs in a wide variety of pulp systems. More importantly, the compositions of the invention are capable of operating on the paper mill pulp systems in amounts ranging from as little as 0.5 ppm up to about 20 ppm. In certain instances, large amounts may be required, e.g., 100 or 200 ppm, but the lower dosage ranges give good results in most cases.

The composition of the invention are primarily designed to prevent pitch buildup in the paper mill systems. It is well known that pitch has favorite places for accumulating on the various apparatus and equipment associated with the processing of pulp. To be effective, the compositions of the invention should be added at a point in the mill system ahead of these so-called problem areas. In certain instances, the compositions may be added at multiple points throughout the system to insure prevention of pulp buildup at several points throughout the wet end of the paper-making process.

Since the compositions of the invention are primarily adapted to disperse pitch already contained in pulp rather than remove heavy accumulations thereof from equipment, the best results are obtained in the practice of the invention when the mill system has been thoroughly cleaned by the use of a cleaning and/or sanitizing agent such as chlorine.

Prior art dispersing compositions which oftentimes contain one of the ingredients of the compositions of this invention, while capable of maintaining pitch in a dispersed condition throughout a paper mill system, are incapable of producing micron to sub-micron particles of pitch which will attach themselves to the fibers in the pulp system, thereby allowing the pitch to be incorporated into the finished product in a finely divided state of subdivision. Prior art compositions tend to allow the pitch to remain with the white water which is reused after sheet formation, thus producing a paper mill by-product which has an undesirable contaminant. When such pitch-containing white waters are re-dispersed back into the pulp, the pitch buildup steadily increases, thus aggravating the pitch deposit problem.

Compositions of the Invention

As indicated generically above, the compositions of the invention contain 3 components. These components are listed below:

| Generic Formula I | | |
|---|---|---|
| Ingredients | | % by weight |
| A. | Non-ionic surfactant | 50–20 |
| B. | Anionic Dispersant | 45–15 |
| C. | Anionic Polymer having molecular weight less than 100,000. | 45–15 |

A more preferred composition falling within the scope of the invention is set forth below:

| Generic Formula II | | |
|---|---|---|
| Ingredients | | % by weight |
| A. | Non-ionic surfactant | 50–30 |
| B. | Anionic Dispersant | 40–20 |
| C. | Anionic Polymer having molecular weight less than 100,000. | 40–20 |

The Non-Ionic Surfactant

This portion of the composition may be selected from a wide variety of non-ionic surfactants. Examples of such non-ionic surfactants are condensation products of higher fatty alcohols with ethylene oxide, such as the reaction product of oleyl alcohol with 10 ethylene oxide units; condensation products of alkylphenols and ethylene oxide, such as the reaction products of isooctylphenol with 12 ethylene oxide units; condensation products of higher fatty acid amides with five, or more, ethylene oxide units; polyethylene glycol esters of long chain fatty acids, such as tetraethylene glycol monopalmitate, hexaethyleneglycol monolaurate, nonaethyleneglycol monostearate, nonaethyleneglycol dioleate, tridecaethyleneglycol monoarachidate, tricosaethylene glycol monobehenate, tricosaethylene-glycol dibehenate, polyhydric alcohol partial higher fatty acid esters such as sorbitan tristearate, ethylene oxide condensation products of polyhydric alcohol partial higher fatty esters and their inner anhydrides (mannitolanhydride, called Mannitan, and sorbitol-anhydride, called Sorbitan), pentaerythritolmonooleate reacted with 12 molecules of ethylene oxide, sorbitan monostearate reacted with 10 to 15 molecules of ethylene oxide; long chain polyglycols in which one hydroxyl group is esterified with a higher fatty acid and the other hydroxyl group is esterified with a low molecular weight alcohol, such as methoxypolyethylene glycol 550 monostearate (550 meaning the average molecular weight of the polyglycol ether). A combination of two or more of these surfactants may be used.

A preferred group of non-ionic surfactants are the alkyl phenols containing 4 to 12 carbon atoms which have been reacted with from 4 to 10 moles of ethylene oxide. A typical material of this type is nonyl phenol which has been reacted with 6 moles of ethylene oxide.

The Anionic Surfactants

Typical anionic surfactants are sodium and potassium myristate, laurate, palmitate, oleate, stearate, resinate, and hydroabietate, the alkali metal alkyl or alkylene sulfates, such as sodium lauryl sulfate, potassium stearyl sulfate, the alkali metal alkyl or alkylene sulfonates, such as sodium lauryl sulfonate, potassium stearyl sulfonate, and sodium cetyl sulfonate, sulfonated mineral oil, as well as the ammonium salts thereof; and salts of higher means like lauryl amine hydrochloride, and stearyl amine hydrobromide.

Other examples of suitable anionic surfactants are alkali metal salts of alkyl-aryl sulfonic acids, sodium dialkyl sulfosuccinate, sulfated or sulfonated oils, e.g., sulfated castor oil; sulfonated tallow, and alkali salts of short chain petroleum sulfonic acids.

A particularly preferred group of anionic dispersants are the alkali metal salts of sulfonated naphthalenes and alkyl substituted naphthalenes.

A particularly prefered material of this type would be an ethyl substituted naphthalene sodium sulfonate.

The Low Molecular Weight Anionic Polymers

These polymers are anionic and usually contain at least 5% by weight of alkali metal, amine or ammonium carboxylate salt groups. To be effective in the practice of the invention, they must have a molecular weight that does not exceed 100,000. In a preferred embodiment of the invention, these materials contain at least 50% or more carboxylate salt groups and have molecular weight ranges within the range of 5,000–40,000.

Typically, polymers of this type are either homo or copolymers of acrylic and/or methacrylic acid. A typical polymer representing a preferred material is a copolymer of acrylic acid and 23% by weight of methyl acrylate which has a molecular weight of about 12,000–15,000.

These polymers may be prepared as co-polymers with other monomers such as acrylamide styrene sulfonates, maleic anhydride, acrylonitrile or other vinyl monomers in amounts sufficient to maintain the polymers with sufficient polar groupings to maintain a substantial degree of water solubility or dispersancy.

The polymers containing acrylic acid may be prepared from low molecular weight homo or co-polymers of acrylonitrile which is subsequently subjected to an aqueous caustic hydrolysis step which converts a substantial portion of the nitrile groups to sodium carboxylate steps. Alternatively, homo or co-polymers of acrylamide may be subjected to alkaline hydrolysis to convert the amide groups to alkaline carboxylate groups.

A typical method for preparing polymers of the above type by nitrile hydrolysis is disclosed in Example I of U.S. Pat. No. 3,419,502, the disclosure of which is incorporated herein by reference.

Using the techniques of the above patent, it is but a simple matter to prepare the polymers useful in the practice of this invention.

Optional Ingredients

The above ingredients are conveniently prepared as an aqueous emulsion by dispersing them in water. These concentrates may contain as little as 5 up to about 45 or 50% by weight of the active ingredients.

Such concentrates may also contain additional ingredients as anti-foams, emulsifying agents, pH adjusting agents for maintaining formulation stability and the like.

A typical composition of the invention would be the following composition:

| Generic Formula III | |
|---|---|
| Ingredients | % by weight |
| Co-polymer of acrylic acid and 23% methyl acrylate (12,000–15,000 MW) | 15 |
| Ethyl naphthalene sodium sulfonate | 6.2 |
| Nonyl phenol reacted with 6 moles of ethylene oxide | 10 |
| Polydimethyl siloxane anti-foam | .05 |
| Water | balance |

EXAMPLE I

To illustrate the invention, the following are presented by weight of example:

A composition corresponding to Formula 3 was tested in the Southern Kraft Mill. The major pitch problem that was experienced in this mill was pitch buildup in the bleach chest. Also, large pitch particles were being entrained in the finished product and were noticeable.

Prior to the tests, the bleach chest which was of concrete construction was mechanically cleaned of pitch deposits. During the first day of the test, Formula 3 was continuously fed at a dosage of 0.5 lbs. per ton, of pulp to the high density dilution line which fed into the bleach chest.

During the second day of the tests, the dosage was increased to 0.8 lbs. per ton of pulp. By mid-afternoon it was established that none of the paper produced was being rejected for dirt or pitch. Microscopic inspection of the paper indicated that the pitch particles introduced therein were of a much smaller size than those found at the beginning of the tests.

On the third day of the tests, the dosage was increased to 1.5 lbs. per ton of pulp. The amount of dirt and pitch in the system was greatly improved. Particle size of the pitch in the paper was extremely small. At the end of the fifth day, with the dosage being continued at 1.5 lbs. per ton of pulp, it was observed that the pitch in the paper was extremely small in particle size and uniformly distributed throughout the sheet. As an ancillary benefit, the dirt in the entire system was reduced by about 75% over the tests.

It was also observed throughout the tests that existing pitch deposits on the equipment were gradually reduced indicating that the compositions of the invention are capable of reducing existing pitch deposits.

I claim:

1. A method of inhibiting pitch formation in paper mill pulp systems which comprises adding to such systems, at a point prior to where pitch deposits normally occur, at least 0.5 ppm, based on the weight of the pulp, of a composition comprising:

| Ingredients | % by weight |
|---|---|
| A. Non-ionic surfactant | 50–20 |
| B. Anionic Dispersant | 45–15 |
| C. Anionic Polymer having molecular weight less than 100,000 | 45–15 |

2. A method of inhibiting pitch formation in paper mill pulp systems which comprises adding to such systems, at a point prior to where pitch deposits normally occur, at least 0.5 ppm, based on the weight of the pulp, of a composition comprising:

| Ingredients | % by weight |
|---|---|
| A. Non-ionic surfactant | 50–30 |
| B. Anionic Dispersant | 40–20 |
| C. Anionic Polymer having molecular weight less than 100,000 | 40–20 |

3. A method of inhibiting pitch formation in paper mill pulp systems which comprises adding to such systems, at a point prior to where pitch deposits normally occur, at least 0.5 ppm, based on the weight of the pulp, of a composition comprising:

| Ingredients | % by weight |
|---|---|
| A. An ethoxylated phenol | 50–30 |

-continued

| Ingredients | % by weight |
|---|---|
| B. Alkyl substituted naphthalene sulfonate | 40–20 |
| C. Acrylic acid co-polymer having a molecular weight between 5,000 and 40,000 | 40–20 |

* * * * *